US006116985A

United States Patent [19]

Lambert

[11] Patent Number: 6,116,985

[45] **Date of Patent: *Sep. 12, 2000**

[54] SPORTS BRASSIERE

[76] Inventor: Hilary Lambert, 170 E. 87 St., Apt. E11F, New York, N.Y. 10128

[ * ] Notice: This patent is subject to a terminal disclaimer.

[21] Appl. No.: 09/175,191

[22] Filed: Oct. 20, 1998

Related U.S. Application Data

[63] Continuation of application No. 08/932,007, Sep. 17, 1997, Pat. No. 5,871,388.

[51] Int. Cl.[7] ..... A41C 3/00

[52] U.S. Cl. ..... 450/31; 430/58

[58] Field of Search ..... 2/73, 104–106, 2/113–115, 109, 110, 69, 69.5, 67; 450/30–32, 58, 79, 80, 91, 92, 17, 7, 70

[56] References Cited

U.S. PATENT DOCUMENTS

| | | | |
|---|---|---|---|
| 1,164,642 | 12/1915 | Guinzburg | 450/58 |
| 1,254,043 | 1/1918 | James | 450/58 |
| 1,363,038 | 12/1920 | Gottlieb | 450/31 |
| 4,637,398 | 1/1987 | Sherwood | 450/31 |
| 4,798,557 | 1/1989 | Scott | 450/31 |
| 4,909,771 | 3/1990 | Bergmann | 450/70 X |
| 5,678,246 | 10/1997 | Cooley et al. | 2/67 |
| 5,871,388 | 2/1999 | Lambert | 450/58 |

*Primary Examiner*—Gloria M. Hale
*Attorney, Agent, or Firm*—DeMont & Breyer, LLC

[57] ABSTRACT

A brassiere physically adapted for use during vigorous exercise is disclosed. The brassiere comprises an underlying support layer that supports the breasts and a resilient overlying motion-restraining layer configured for restricting breast movement. Each of the layers is independently-supported by an associated pair of straps. The brassiere substantially reduces motion that would otherwise be imparted to the breasts during vigorous exercise.

19 Claims, 3 Drawing Sheets

SPORTS BRASSIERE

This application is a continuation of application Ser. No. 08/932,007, filed Sep. 17, 1997, U.S. Pat. No. 5,871,388.

FIELD OF THE INVENTION

The present invention relates to an improved brassiere. More particularly, the present invention relates to a brassiere adapted for use during athletic activity.

BACKGROUND OF THE INVENTION

The female breast is composed predominantly of fatty tissue. Lacking overlying muscle, the breast is supported by skin and ligaments. Such supporting skin and ligaments are readily stretched and further gradually lose elasticity as part of the normal aging process.

Additional support for the breast may be provided by a brassiere (bra). While a general use or "everyday" bra provides adequate support for more sedate or non-athletic activities, such bras fail to provide the support needed during vigorous activity, such as running, aerobics or the like. Such activities may generate substantial forces that tend to impart vertical and/or lateral components of motion to the breasts. Aside from causing discomfort and pain, such motion can accelerate and exacerbate the stretching of skin and ligaments, resulting in sagging of the breasts. The larger the breast, the more acute the problem is likely to be. To address the increased support requirements occasioned by vigorous exercise, the sports or exercise bra was developed.

The sports bra is intended to restrain the breasts from moving in response to the aforementioned forces, yet must provide freedom of movement and comfort to the wearer. Current sports bra designs are based on at least one of two underlying design principles: encapsulation and compression. Encapsulation bras seek to firmly and individually confine each breast within a cup-like structure. Compression bras force the breasts against the chest as a single mass. Compression bras are likely to be more suitable for smaller- rather than larger-breasted women.

A wide variety of sports bras are currently available. It is expected that some of such bras provide satisfactory support for smaller-breasted women engaging in vigorous activity. Current sports bras are, however, of dubious value for meeting the needs of larger-breasted women engaging in such vigorous activity.

SUMMARY OF THE INVENTION

A brassiere (bra) suitable for use by larger-breasted women engaging in vigorous exercise is disclosed. The present bra substantially reduces motion that would otherwise be imparted to the breasts during vigorous exercise. According to the invention, the bra comprises an underlying support layer physically adapted for supporting the breasts that is attached to an overlying motion-restraining layer physically adapted for restricting breast movement. Each of the layers is independently-supported by an associated pair of straps.

In an exemplary embodiment of the present invention, the support layer is an underbra configured in the manner of an everyday bra. The motion-restraining layer is an outer shell formed of a resilient material. The underbra and the outer shell are supported independently of one another, each by its own pair of straps.

Some conventional encapsulation-based sport bras include a resilient material overlying breast-engaging cups or the like. In such bras, the cups are sewn or otherwise attached to such overlying resilient material, which material is typically supported by straps. Thus, in such bras, both the overlying material and the breast-engaging cups are disadvantageously supported by a single pair of straps. Moreover, the breast-engaging cups are directly supported by the resilient material, rather than the straps. In the present bra, the support and the restraint functions are advantageously provided, predominantly, by independently-supported elements. And, by directly supporting the breast-engaging cups, the present bra provides greater support than the aforementioned conventional sport bras having cups integrated with overlying material.

DESCRIPTION OF THE DRAWINGS

Further features of the invention will become more apparent from the following detailed description of specific embodiments thereof when read in conjunction with the accompanying Figures in which.

DETAILED DESCRIPTION OF THE PRESENT INVENTION

Figure 1:
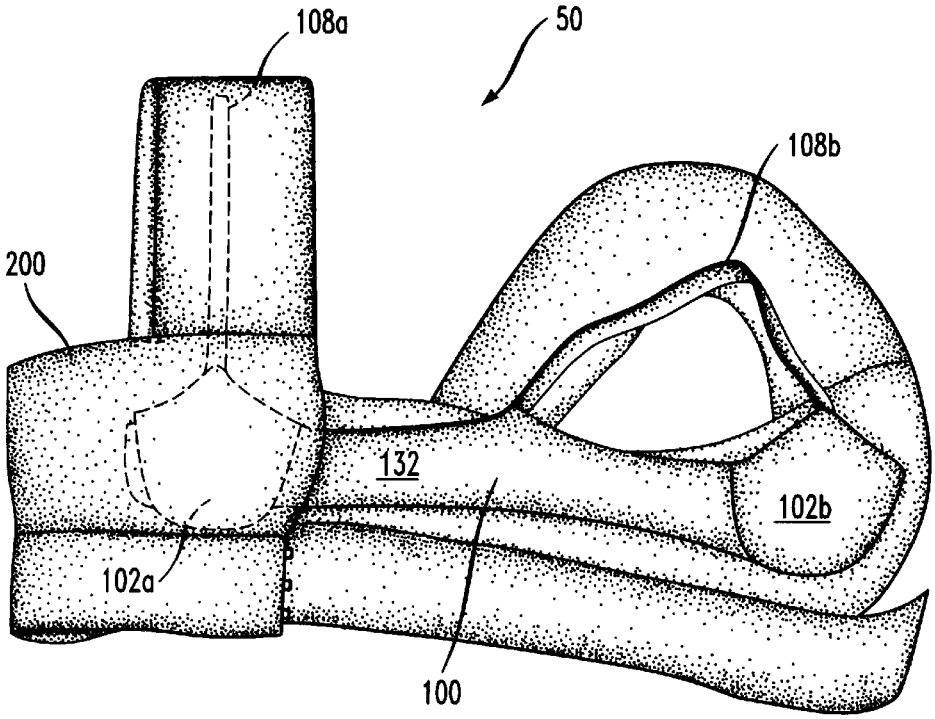
FIG. 1 is a front view of an exemplary embodiment of the present bra, wherein, the bra is unfastened and partially opened to provide a view of an underbra.

An exemplary embodiment of a brassiere (bra) in accordance with the present invention is shown in FIG. 1. The present bra 50 includes an underbra 100 and an outer shell 200. The underbra 100 is configured in the manner of an everyday bra, and includes breast-engaging cups 102*a*, 102*b*, two shoulder straps 108*a*, 108*b*, and a backband 132, all of which are formed of a preferably soft, moisture absorbing, quick drying and resilient material. Preferred materials include, without limitation, blends of nylon and spandex; nylon, spandex and cotton; polyester, cotton and spandex, and the like.

Figure 2:
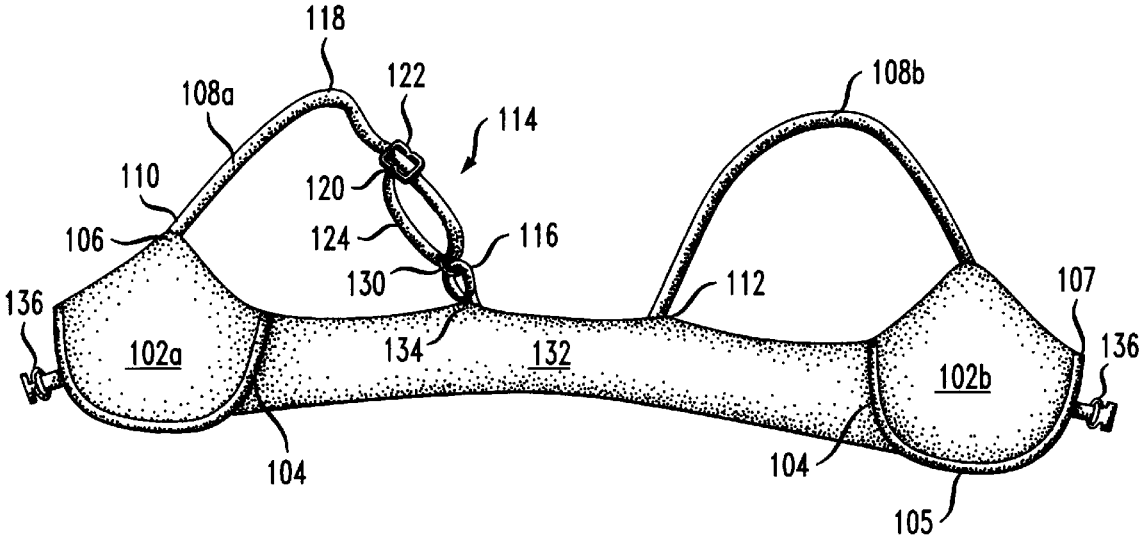
FIG. 2 shows a view of the underbra of FIG. 1 (outer shell not shown for clarity), wherein the underbra is unfastened.

As shown in FIG. 2, which shows only the underbra 100 for clarity of presentation, each breast-engaging cup 102*a*, 102*b* is attached at a distal edge 104 to the backband 132. The shoulder straps 108*a*, 108*b* depend, at a first end 110, one from an upper portion 106 of each breast-engaging cup 102*a*, 102*b*. At a second end 112, each shoulder strap 108*a*, 108*b* depends from the backband 132, thereby forming "loops" for receiving a wearer's shoulders. The shoulder straps rest on an upper surface of the trapezius muscles/shoulders providing support for the wearer's breasts. A fastener/separator 136 located between the breast-engaging cups 102*a*, 102*b* detachably couples said breast-engaging cups. The fastener/separator 136 aids in stabilizing each breast and in maintaining the breasts in proper separated relation from one another. The fastener/separator 136 may be a clasp or other connector. In preferred embodiments, the fastener/separator 136 is configured to maintain sufficient spacing between the cups 102*a*, 102*b* to enhance breathability. The "spacing" function of the fastener/separator 136 will be described further later in this specification.

A bra must fit correctly to provide maximum support. As breast-to-shoulder distance varies among individuals, the ability to adjust the length of the shoulder straps is desirable, if not necessary, for a correct fit across a range of body sizes. To that end, in preferred embodiments, each shoulder strap 108*a*, 108*b* includes a strap adjuster 114 operable to adjust the length of the shoulder straps. For clarity of illustration, the strap adjuster 114 is shown only for the strap 108*a*.

The strap adjuster 114 can be configured in any of a variety of ways known to those skilled in the art. In the exemplary embodiment shown in FIG. 2, the strap adjuster 114 is implemented as a ring and buckle arrangement. In the illustrated implementation, the shoulder strap 108*a* is comprised of two portions, a shorter fixed strap portion 116 attached to an upper edge 134 of the backband 132, and a longer adjustable strap portion 118 attached to the upper portion 106 of each breast-engaging cup 102*a*, 102*b*. A buckle 122 is attached to the end 120 of the longer adjustable strap portion 118. The longer adjustable strap portion 118 is threaded through the buckle 122 forming variable-size loop 124. The variable-size loop 124 is received by a loop 130, formed from plastic or the like, attached to the shorter fixed strap portion 116. To reduce strap length, the buckle 122 is moved towards the first end 110 of the shoulder straps 108*a*, 108*b*, increasing the size of the variable-size loop 124. Such an increase in the size of loop 124 reduces the effective length of the shoulder strap 108*a*, 108*b*. To increase strap length, the buckle 122 is moved towards the second end 112 of the shoulder straps, decreasing the size of the variable-size loop 124.

In some embodiments of the present invention, a support member 105 is located along a substantial portion of the perimeter 107 of the breast-engaging cups 102*a*, 102*b*. The support member 105 provides additional support that may be required for larger-breasted women. In a presently-preferred embodiment, the support member 105 is an "underwire," familiar to those skilled in the art. In other embodiments, non-elastic material disposed along the perimeter 107 may suitably be used. In yet additional embodiments, a lower portion of each breast-engaging cup 102*a*, 102*b* can be formed of an inelastic material that is molded into the shape of breasts.

Figure 3:
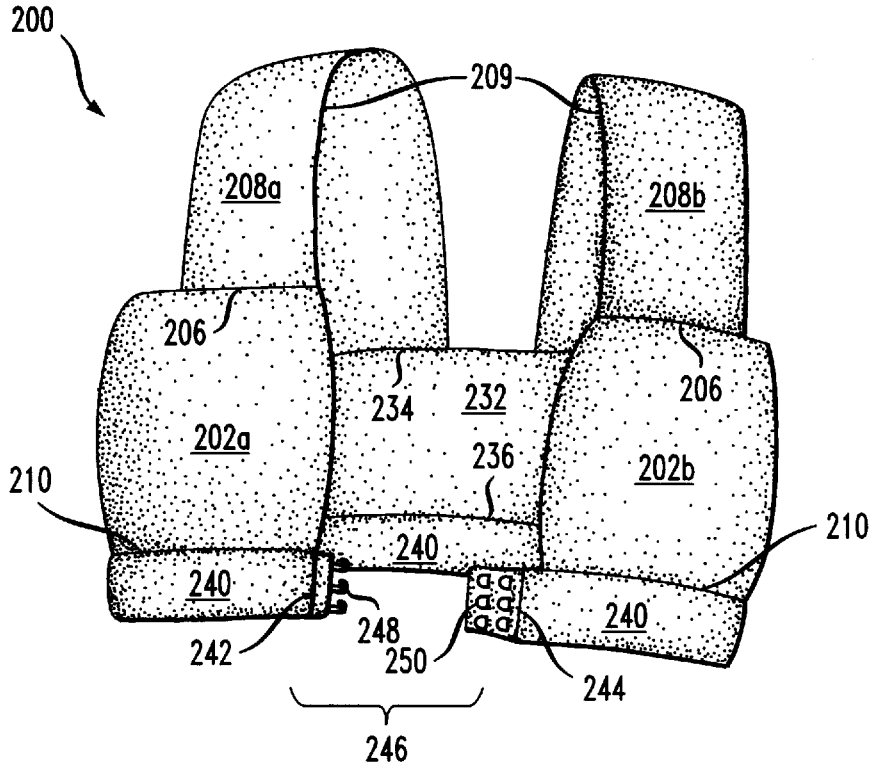
FIG. 3 shows a front perspective view of an exemplary embodiment of an outer shell of FIG. 1 (underbra not shown for clarity), wherein the outer shell is unfastened.
Figure 4:
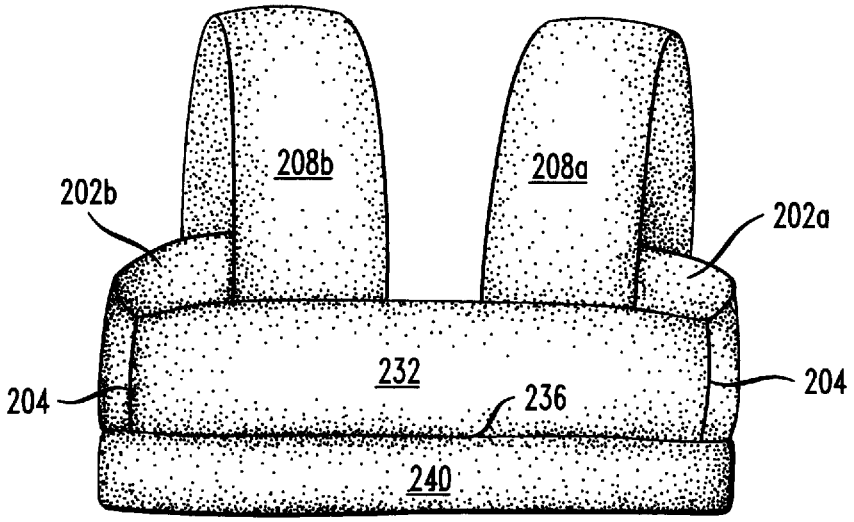
FIG. 4 is a back perspective view of the outer shell of FIG. 3.

While the underbra 100 provides, predominantly, a support function, the outer shell 200 is configured to restrain the breasts from motion, as well as providing support. Referring to FIGS. 3 and 4, which show only the outer shell for clarity of presentation, the outer shell 200 includes two resilient chest panels 202*a*, 202*b*, two wide resilient shoulder panels 208*a*, 208*b*, a resilient back panel 232 and wide elastic rib band 240. The panels can be formed from the same materials as the underbra 100.

Each shoulder panel 208*a*, 208*b* depends, at first end, from an upper portion 206 of each chest panel 202*a*, 202*b*, and depends, at a second end, from an upper edge 234 of the back panel 232. Preferably, proximal edge 209 of each shoulder panel 208*a*, 208*b* is adjacent to the wearer's neck so that the shoulder panels are biased toward the centerline of the body. Positioning the shoulder panels close to the centerline of the body, as described above, minimizes the tendency for the shoulder panels to slip off of the shoulders. Alternatively, the shoulder panels may "criss-cross" over the wearer's back, preventing the aforementioned slippage.

The back panel 232 is attached to distal edge 204 of each chest panel 202*a*, 202*b*. The rib band 240 depends from a bottom edge 236 of the back panel and the bottom edge 210 of the chest panels 202*a*, 202*b*. The rib band 240 is detachably coupled by a closure means 246. In the embodiment shown in FIG. 3, the closure means 246 is a hook and eyelet arrangement, well known in the art. Hooks 248 are disposed on a first end 242 of the rib band 240, and eyelets 250 are disposed on a second end 244 of the rib band. In use, the bra 50 is positioned on a user's chest and the hooks 248 are placed in mating engagement with the eyelets 250. Multiple rows of eyes 244 or hooks 246 can be disposed on the rib band 240 to provide girth adjustment.

In one embodiment, the various "panels" comprising the outer shell 200, i.e., the chest panels 202*a*, 202*b*, the shoulder panels 208*a*, 208*b* and the back panel 232, can each be a discrete portion of material. The outer shell 200 is then formed by attaching the panels to one another, such as by sewing. In an alternative embodiment, the chest and back panels may be made from a single piece of material to which the shoulder panels are attached. In other embodiments, other "panels," e.g., chest and shoulders, may be made from a single piece of material to which one or more of the remaining panels, e.g., back, are attached. Moreover, the outer shell 200 can be formed from a single piece of material. In view of the foregoing, it will be appreciated that the designation "panel" is figurative; a panel simply represents a region of the outer shell 200.

Figure 5:
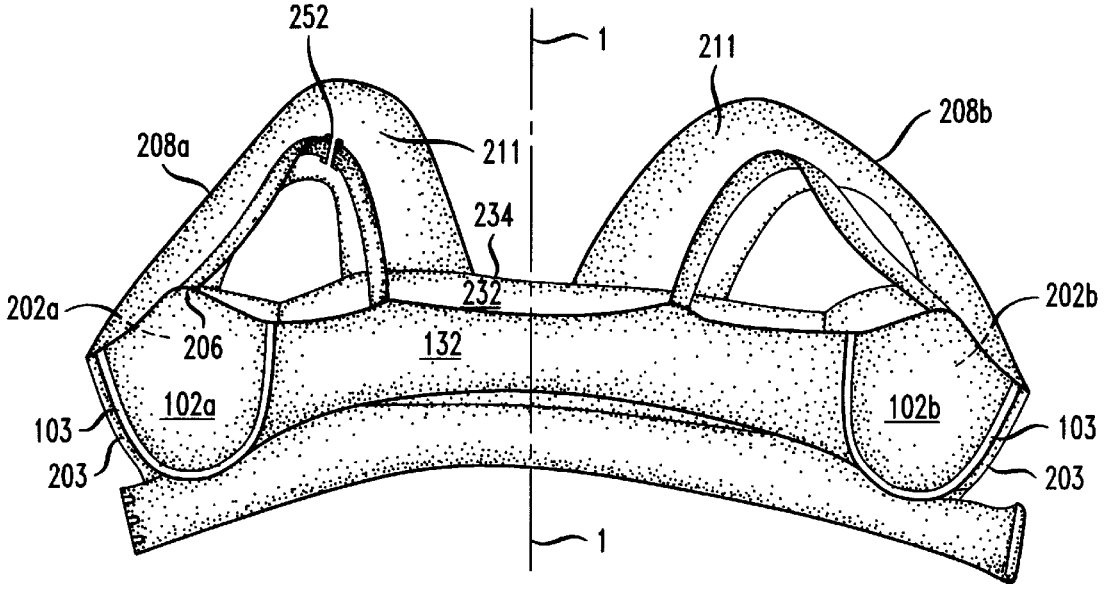
FIG. 5 is a front view of an exemplary embodiment of the present bra, wherein the bra is fully opened providing a view of the underbra.

Referring now to FIG. 5, the underbra 100 is preferably attached to the outer shell 200 at several locations. Preferred attachment locations are along a proximal edge 103 of each breast-engaging cup 102*a*, 102*b*, which is attached to proximal edge 203 of the overlying chest panel 202*a*, 202*b*, and at a centerline 1—1 of the bra 50, wherein the backband 132 is attached to overlying back panel 232. Attachment can be effected by sewing, or by detachable fastening means, such as, for example, Velcro™ fasteners, snaps and the like. Use of detachable fasteners allows for separating the underbra 100 from the outer shell 200. In use, the resilient chest panels 202*a*, 202*b* aid in keeping the breast-engaging cups 102*a*, 102*b* appropriately separated, as well as substantially restraining any movement thereof It is desirable for the shoulder straps 108*a*, 108*b* of the underbra 100 to remain completely out-of-view underneath the shoulder panels 208*a*, 208*b* when the bra 50 is in use. As such, strap retaining means 252 is preferably provided along under-surface 211 of each shoulder panel 208*a*, 208*b*. In the embodiment illustrated in FIG. 5, strap retaining means 252 is simply two closely-spaced slits disposed on the under-surface 211 of each shoulder panel 208*a*, 208*b*. It will be appreciated that if the strap retaining means are slits, then the shoulder panels 208*a*, 208*b* will comprise at least two layers of material. Only one of such layers is slit. In another embodiment, not shown, the strap retaining means may be a loop formed by sewing a piece of material, at its ends, to the under-surface 211 of each shoulder panel. In an additional embodiment, the strap retaining means 252 comprises a vertically elongated hook and loop fastener, sold under the trademark "Velcro." In such an embodiment, a first strip of Velcro™ is disposed on an upper surface of each shoulder strap 108*a*, 108*b*, and a second strip of Velcro™ is disposed on the under-surface 211 of each shoulder panel 208*a*, 208*b*. The first and second strips are aligned for mating engagment.

If the strap retaining means 252 is embodied as two closely-spaced slits in each shoulder panel, then such slits should be located near a midpoint along the length of the shoulder panels 208*a*, 208*b*. The pressure exerted on the wearer by the shoulder panels will be at a maximum at that region since the midpoint substantially aligns with the bra-supporting upper surface of the shoulder/trapezius region of the wearer. Disposing the strap retaining means 252 at that location may result in discomfort to the wearer. As such, if the strap retaining means 252 comprises two closely-spaced slits, a single loop, a single Velcro™ fastener or the like, it should be located slightly forward of, or behind, the maximum-pressure region.

In other embodiments, not shown, strap retaining means 252 includes two sets of two closely-spaced slits, two loops, two Velcro™ fasteners or the like, one of which slit sets, loops, etc. is located on the under-surface 211 of each shoulder panel 208*a*, 208*b* about midway between the upper portion 206 of the chest panels 202*a*, 202*b* and the upper surface of the shoulder/trapezius region of the wearer. The other slit set, loop, etc. is located on the under-surface 211 of each shoulder panel about midway between said upper surface and the upper edge 234 of the back panel 232. In an additional embodiment, not shown, two single slits can be located, one each, at the aforementioned midway points. In such an embodiment, the shoulder straps 108*a*, 108*b* enter one of the slits in the corresponding shoulder panels 208*a*, 208*b*, travel within the shoulder panels, and emerge at the other slit.

Figure 6:
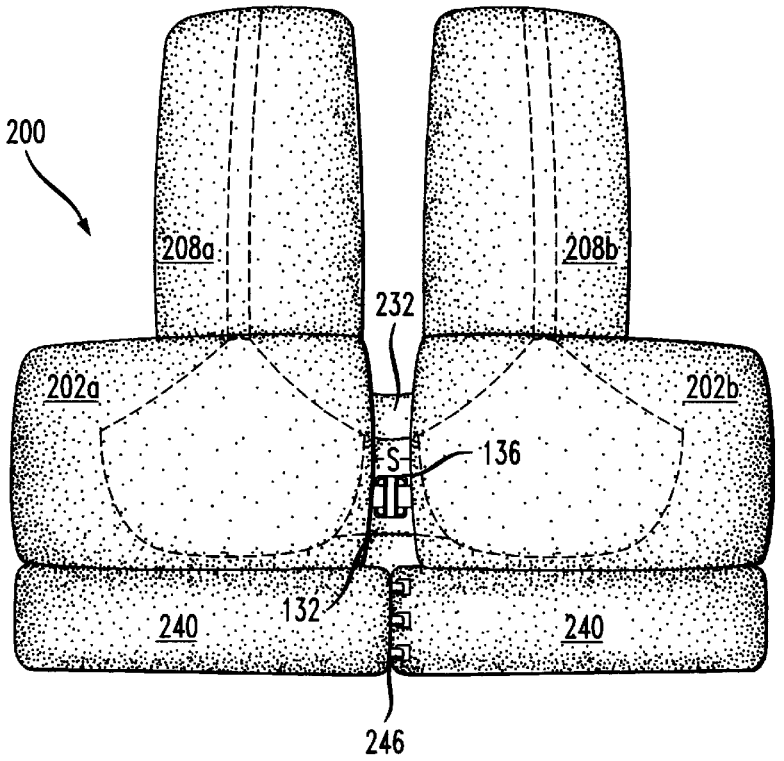
FIG. 6 is a front view of the bra of FIG. 5, wherein the bra is closed as in use.

As previously described, the fastener/separator 136 located between the breast-engaging cups 102*a*, 102*b* detachably couples the breast-engaging cups 102*a*, 102*b*, and further stabilizes each breast and maintains the breasts in proper separated relation. The fastener/separator also detachably couples the chest panels 202*a*, 202*b*. It was also noted that, in preferred embodiments, the fastener/separator 136 is configured to maintain sufficient spacing between the cups 102*a*, 102*b* to enhance breathability. As shown in FIG. 6, the fastener/separator also maintains a separation between the two chest panels 202*a* and 202*b* when in use. In addition to enhancing breathability, such separation also allows for adjustment of the outer shell 200. A spacing s within the range of about ¾ to 1¼ inches has been found to be particularly satisfactory for such purposes. To the extent that conventional sports bras possess a means for separating the breasts, such means is typically a piece of material or the like that is sewn between the breast-engaging cups. Using a piece of material for the separating the breasts disadvantageously inhibits breathability and also interferes with the wearers ability to adjust the bra.

Although specific embodiments of this invention have been described herein, it is to be understood that these embodiments are merely illustrative of the principles of this invention. Numerous and varied modifications may occur to, and be implemented by, those of ordinary skill in the art in view of the present teachings without departing from the scope and the spirit of the invention.

I claim:

1. A brassiere comprising:

an underbra having first and second breast-engaging cups attached to a backband and supported by a first pair of shoulder straps, the underbra further physically adapted to maintain the first and second breast-engaging cups in spaced relation from one another such that a first air gap exists between said first and second breast-engaging cups; and an outer shell having first and second chest panels overlying the first and second breast-engaging cups, respectively, the outer shell supported by a second pair of shoulder straps and physically adapted to maintain the first and second chest panels in spaced relation from one another such that a second air gap exists between said first and second chest panels.

2. The brassiere of claim 1, wherein the physical adaptation of the underbra is a spacer.

3. The brassiere of claim 2, wherein spacer is operable to detachably couple the first and second breast-engaging cups.

4. The brassiere of claim 3, wherein, in conjunction with a rib band and depending closure means, the spacer is operable to detachably couple the first and second chest panels.

5. A brassiere comprising:

a support layer having:

first and second shoulder straps, first female coupling means that receives a first male coupling means to detachably couple a first and a second end of the support layer, first spacing means that spaces the coupled first and second ends of the support layer, resulting in a first space therebetween; and a motion-restraining layer overlying the support layer and having:

third and fourth shoulder straps, second male coupling means that receives a second female coupling means to detachably couple a first and a second end of the motion-restraining layer, second spacing means that spaces the coupled first and second ends of the motion-restraining layer, resulting in a second space therebetween.

6. The brassiere of claim 5, wherein the second space overlies the first space.

7. The brassiere of claim 6, wherein the first spacing means comprises the first male and first female coupling means.

8. The brassiere of claim 7, wherein the first male coupling means is attached to the first end of the support layer and first female coupling means is attached to the second end of the support layer.

9. The brassiere of claim 5, wherein the second spacing means comprises the second male and second female coupling means.

10. The brassiere of claim 9, wherein the second male coupling means is attached to the first end of the motion-restraining layer and second female coupling means is attached to the second end of the motion-restraining layer.

11. The brassiere of claim 7, wherein the functionality of the second spacing means is provided by the first spacing means.

12. The brassiere of claim 8, wherein the functionality of the second spacing means is provided by the first spacing means.

13. The brassiere of claim 9, wherein the functionality of the first spacing means is provided by the second spacing means.

14. The brassiere of claim 10, wherein the functionality of the first spacing means is provided by the second spacing means.

15. The brassiere of claim 5, wherein the first shoulder strap is physically coupled to the third shoulder strap and the second shoulder strap is physically coupled to the fourth shoulder strap.

16. A brassiere comprising:

an underbra having first and second breast-engaging cups that are supported by a first support means, wherein, when in use, the first and second breast-engaging cups are maintained in spaced relation from one another by first spacing means, the spaced relation defining a first gap; and an outer shell having first and second chest panels overlying the first and second breast-engaging cups, respectively, the outer shell supported by a second support means, wherein, when in use, the first and second chest panels are maintained in spaced relation from one another by second spacing means, the spaced relation defining a second gap;

wherein the first and second support means are independently supported by at least one part of a user's body.

17. The brassiere of claim 16, wherein the first and second spacing means are the same device.

18. The brassiere of claim 17, wherein the first spacing means is a fastener, a first part of which fastener depends from a first end of the underbra, a second part of which fastener depends from a second end of the underbra, and wherein the first part of the fastener is operable to engage the second part of the fastener to detachably couple the first and second ends of the underbra, and further wherein, when coupled, a separation between the first end and the second end of the underbra defines the spaced relation of the first and second breast-engaging cups.

19. The brassiere of claim 17, wherein the second spacing means is a fastener, a first part of which fastener depends from a first end of the outer shell, a second part of which fastener depends from a second end of the outer shell, and wherein the first part of the fastener is operable to engage the second part of the fastener to detachably couple the first and second ends of the outer shell, and further wherein, when coupled, a separation between the first end and the second end of the outer shell defines the spaced relation of the first and second chest panels.

* * * * *